US011150012B2

(12) United States Patent
Ahn et al.

(10) Patent No.: US 11,150,012 B2
(45) Date of Patent: Oct. 19, 2021

(54) REFRIGERATOR AND METHOD OF CONTROLLING THE SAME

(71) Applicant: LG ELECTRONICS INC., Seoul (KR)

(72) Inventors: Seunguk Ahn, Seoul (KR); Sunam Chae, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 16/621,731

(22) PCT Filed: Jun. 12, 2018

(86) PCT No.: PCT/KR2018/006634
§ 371 (c)(1),
(2) Date: Dec. 12, 2019

(87) PCT Pub. No.: WO2018/230925
PCT Pub. Date: Dec. 20, 2018

(65) Prior Publication Data

US 2020/0116424 A1 Apr. 16, 2020

(30) Foreign Application Priority Data

Jun. 12, 2017 (KR) ..... 10-2017-0073341
Mar. 22, 2018 (KR) ..... 10-2018-0033315

(51) Int. Cl.
*F25D 11/02* (2006.01)
*F25D 29/00* (2006.01)
(Continued)

(52) U.S. Cl.
CPC ..... *F25D 29/003* (2013.01); *F25D 11/02* (2013.01); *F25D 17/045* (2013.01);
(Continued)

(58) Field of Classification Search
CPC ..... F25D 11/02; F25D 17/045; F25D 17/062; F25D 17/065; F25D 2500/04;
(Continued)

(56) References Cited

U.S. PATENT DOCUMENTS 5,524,447 A 6/1996 Shim
6,526,770 B1 * 3/2003 Tang ..... F25D 29/00 62/209
(Continued)

FOREIGN PATENT DOCUMENTS

CN 1470833 1/2004
CN 102356293 2/2012
(Continued)

OTHER PUBLICATIONS

International Search Report dated Sep. 27, 2018 issued in Application No. PCT/KR2018/006634.
(Continued)

*Primary Examiner* — Filip Zec
(74) *Attorney, Agent, or Firm* — KED & Associates, LLP

(57) ABSTRACT

A method of controlling a refrigerator includes: controlling a cooling unit such that an output of the cooling unit becomes a first reference output for a first reference time previously determined; controlling the cooling unit such that the output of the cooling unit becomes a second reference output for a second reference time previously determined; calculating a representative value of a temperature of a storage compartment for an operating period, which is made by a sum of the first reference time and the second reference time, and comparing the calculated representative value with a specific temperature in a temperature satisfying range of the storage compartment; and varying, by a control unit, at least one of the first reference time and the second reference time depending on a comparison result between the specific
(Continued)

temperature and the representative value and controlling operating of the cooling unit based on a varied reference time.

20 Claims, 7 Drawing Sheets

(51) Int. Cl.
*F25D 17/04* (2006.01)
*F25D 17/06* (2006.01)

(52) U.S. Cl.
CPC .... *F25D 17/065* (2013.01); *F25B 2600/0251* (2013.01); *F25D 2500/04* (2013.01); *F25D 2700/12* (2013.01); *F25D 2700/122* (2013.01)

(58) Field of Classification Search
CPC ..... F25D 2700/12; F25D 2700/122; F25D 29/00; F25D 29/003; F25B 2600/0251
See application file for complete search history.

(56) References Cited

U.S. PATENT DOCUMENTS

| | | | | |
|---|---|---|---|---|
| 6,622,503 | B1 * | 9/2003 | Bennett | F25D 17/065 62/151 |
| 9,303,907 | B2 * | 4/2016 | Kawano | F25B 45/00 |
| 2012/0023980 | A1 | 2/2012 | Lee et al. | |
| 2014/0070951 | A1 | 3/2014 | Shim et al. | |
| 2016/0265829 | A1 | 9/2016 | Park et al. | |

FOREIGN PATENT DOCUMENTS

| | | |
|---|---|---|
| CN | 103261823 | 8/2013 |
| CN | 103459955 | 12/2013 |
| CN | 104236249 | 12/2014 |
| JP | S59-46437 | 3/1984 |
| JP | 2006-242531 | 9/2006 |
| KR | 10-1988-0010299 | 10/1988 |
| KR | 10-1997-0022182 | 5/1997 |
| KR | 10-0129507 | 4/1998 |
| KR | 10-2012-0105234 | 9/2012 |
| KR | 10-1698105 | 1/2017 |
| KR | 10-1705528 | 2/2017 |
| RU | 2137064 | 9/1999 |
| RU | 2285873 | 10/2006 |
| RU | 2334921 | 9/2008 |
| WO | WO 2006/012720 | 2/2006 |

OTHER PUBLICATIONS

Russian Office Action dated May 20, 2020 issued in Application No. 2019134584 (English translation attached).
Chinese Office Action dated Dec. 1, 2020 issued in Application No. 201880028782.6.
European Search Report dated Feb. 10, 2021 issued in Application No. 18818712.4.

* cited by examiner

[Fig. 1]
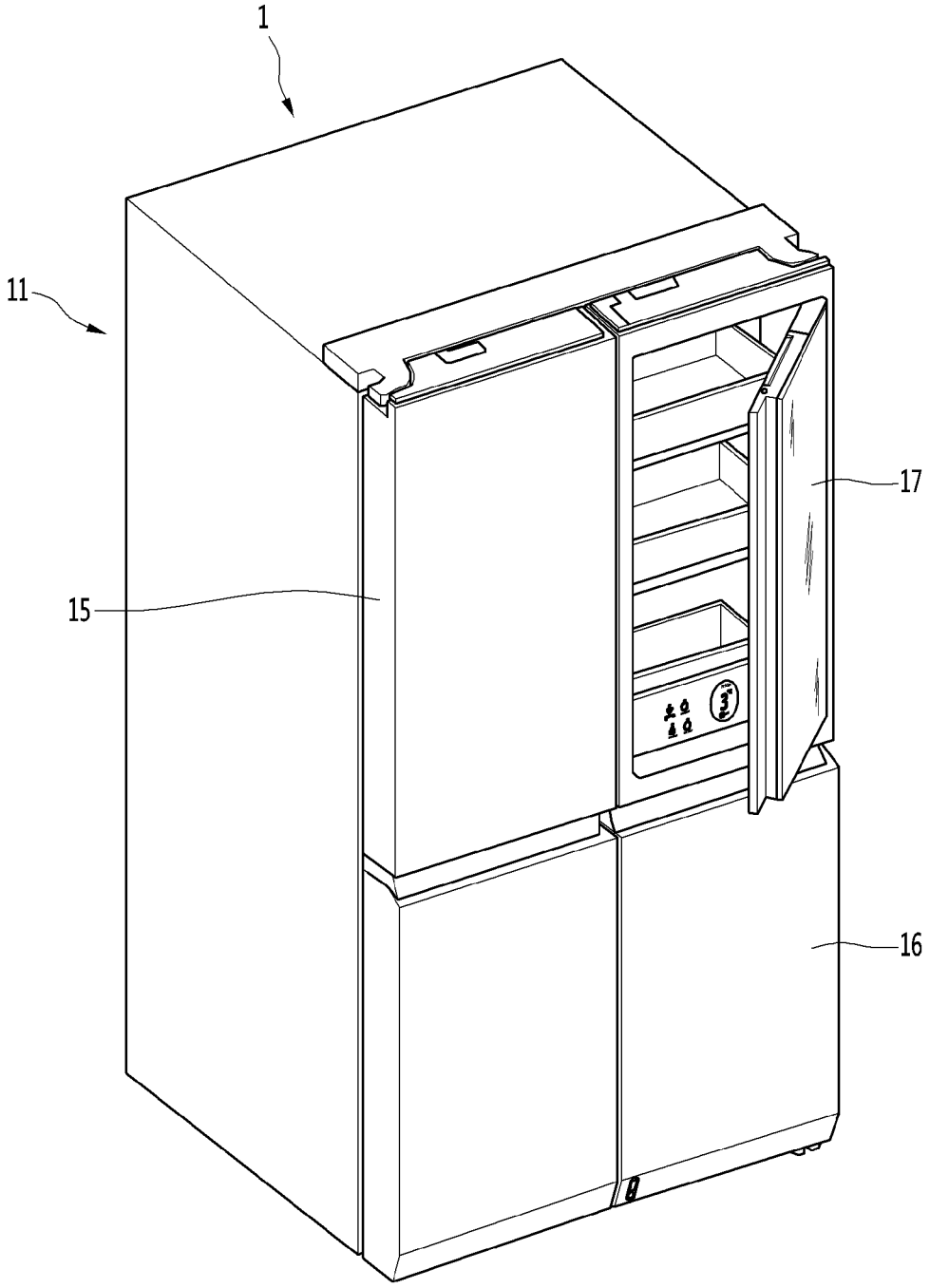

[Fig. 2]
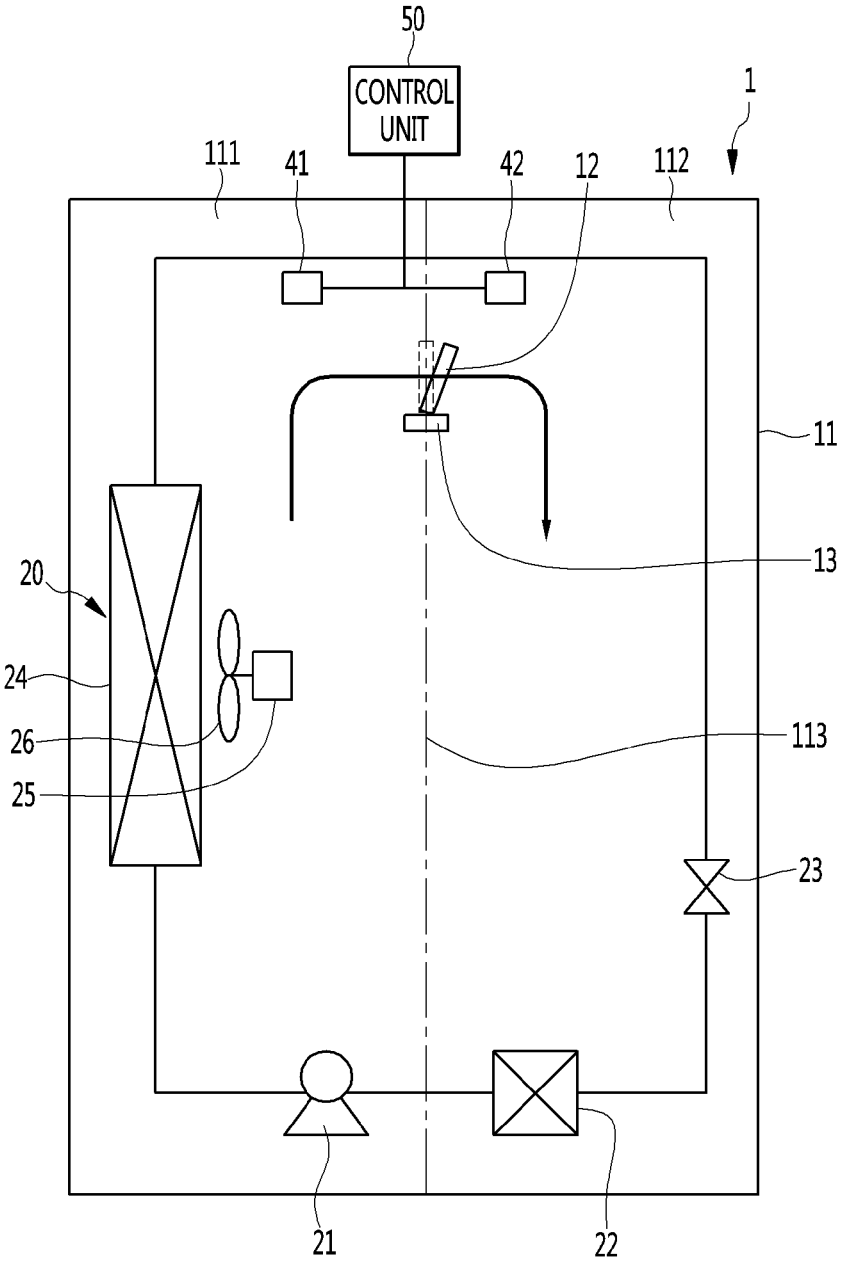

[Fig. 3]
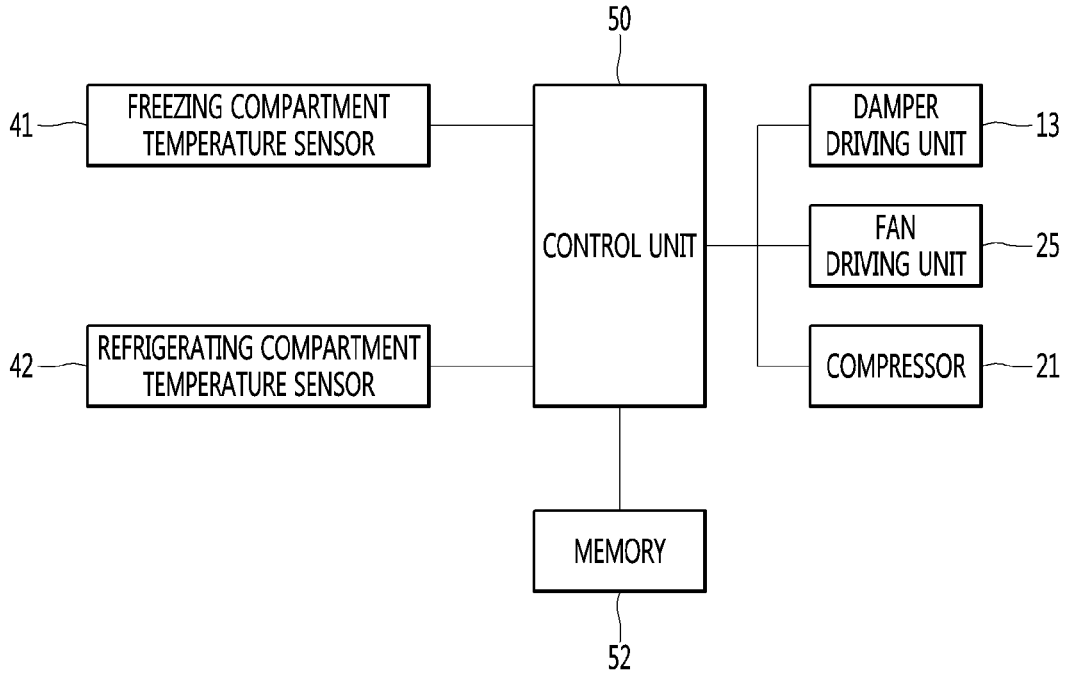

[Fig. 4]
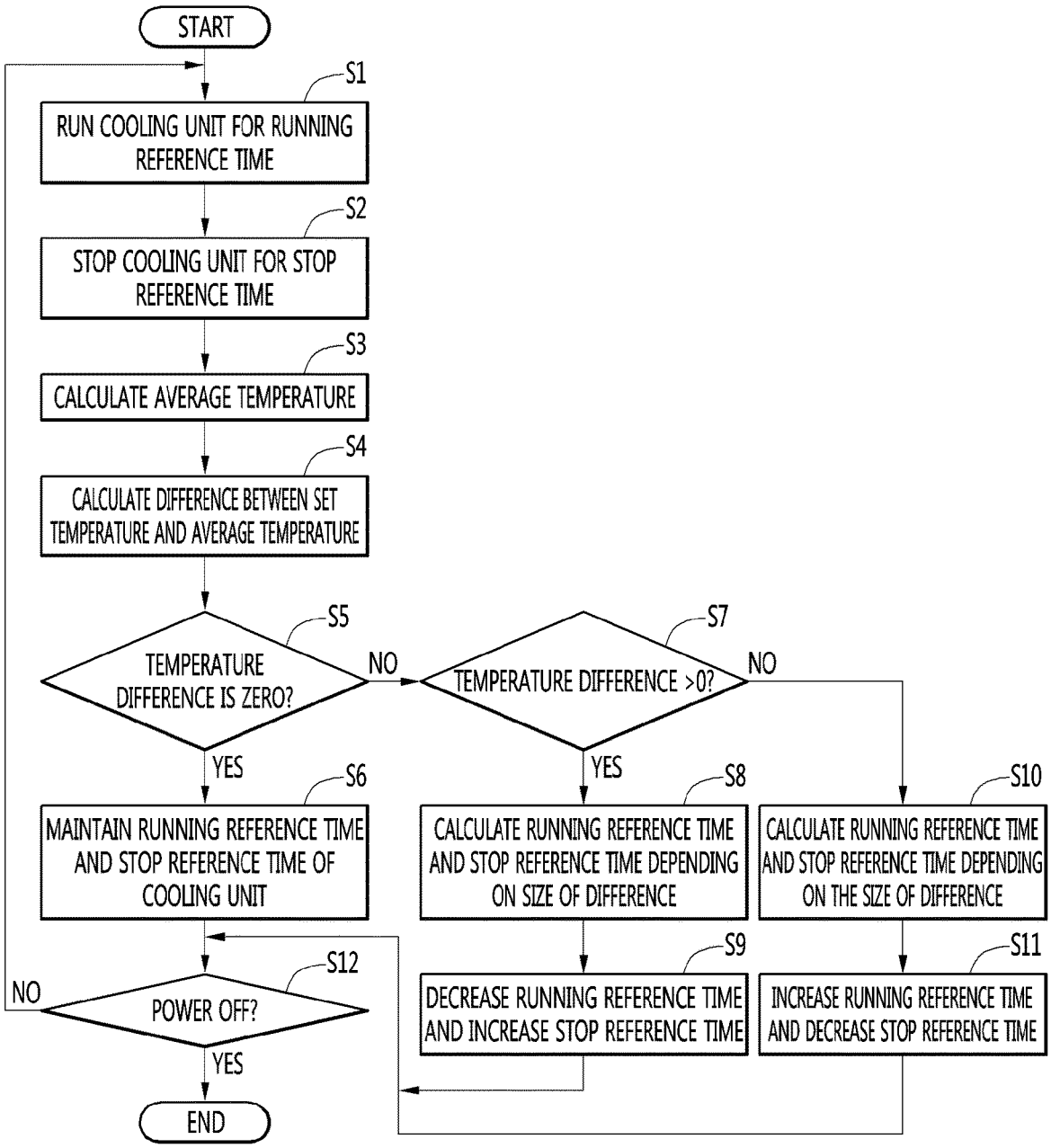

[Fig. 5]
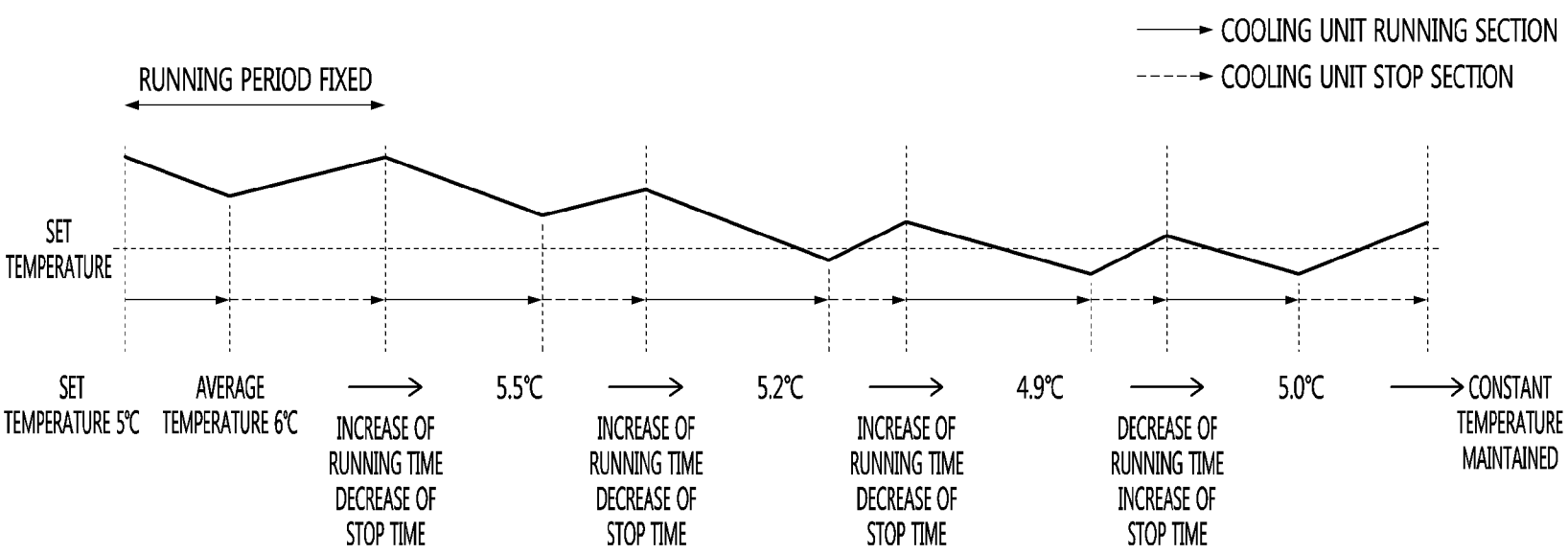

[Fig. 6]
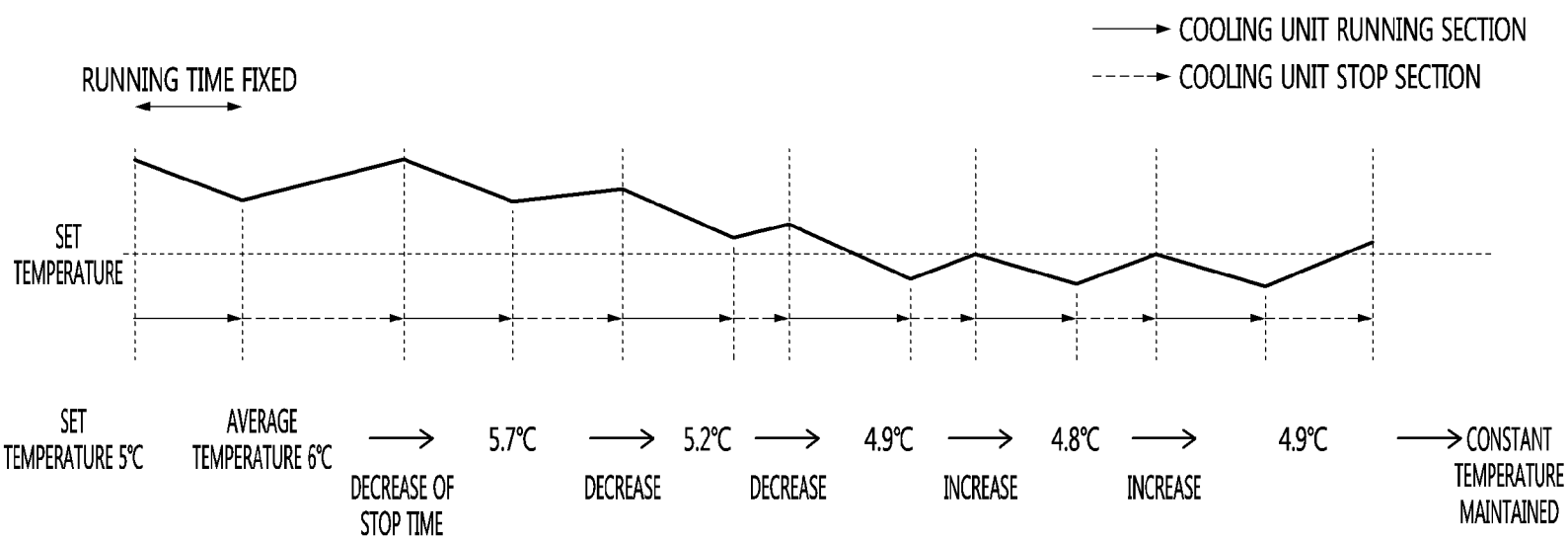

[Fig. 7]
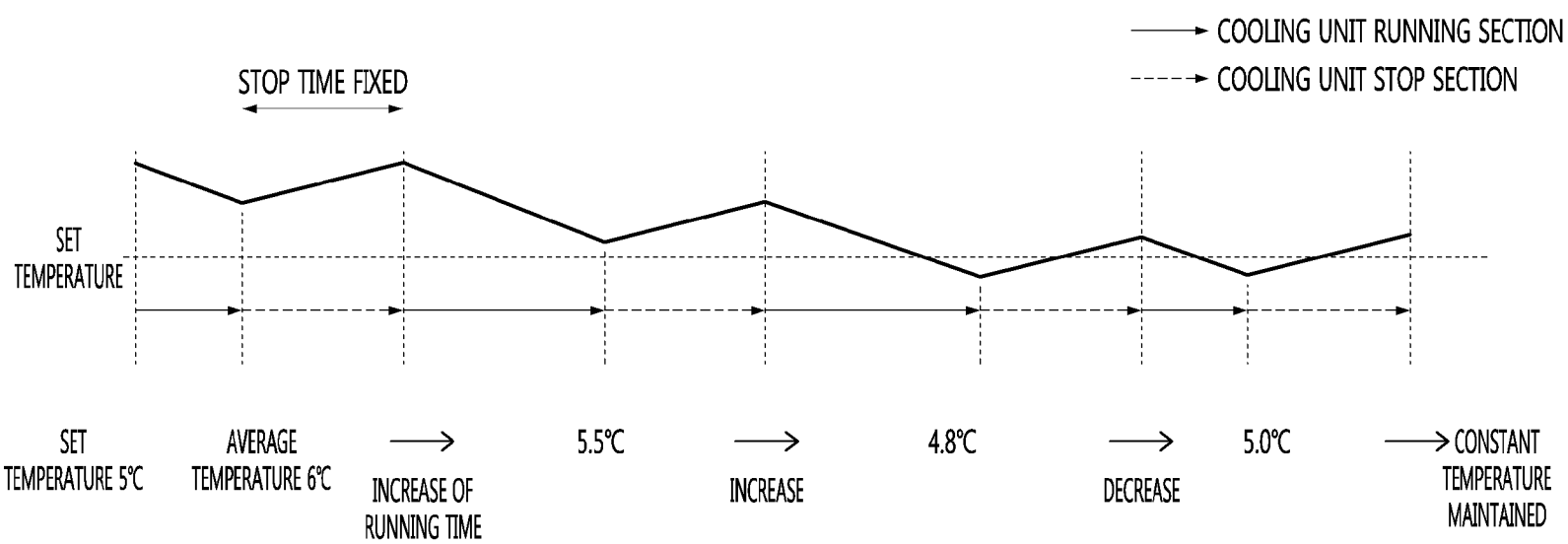

REFRIGERATOR AND METHOD OF CONTROLLING THE SAME

CROSS-REFERENCE TO RELATED PATENT APPLICATIONS

This application is a U.S. National Stage Application under 35 U.S.C. 0371 of PCT Application No. PCT/KR2018/006634, filed Jun. 12, 2018, which claims priority to Korean Patent Application Nos. 10-2017-0073341, filed Jun. 12, 2017 and 10-2018-0033315, filed Mar. 22, 2018, whose entire disclosures are hereby incorporated by reference.

TECHNICAL FIELD

The present invention relates to a refrigerator and a method of controlling the same.

BACKGROUND ART

A refrigerator is a home appliance to store foods at a lower temperature and compartments of the refrigerator need to be constantly maintained at a lower temperature. Recently, in the case of a home refrigerator, the storage compartments have been maintained in the temperature range from an upper limit to a lower limit based on a set temperature. In other words, when the temperature of the storage compartment is raised to the upper limit, the storage compartment is cooled at a freezing cycle. When the temperature of the storage compartment reaches the lower limit, the freezing cycle is stopped, thereby controlling the refrigerator.

Korean Unexamined Patent Publication No. 1997-0022182 (published on May 28, 1997) discloses a constant control method of maintaining a storage compartment of the refrigerator at a constant temperature.

According to the prior art, when the temperature of the storage compartment is higher than a set temperature, a compressor and a fan are driven while a damper of the storage compartment is fully open. When the temperature of the storage compartment is cooled to the set temperature, the driving of the compressor and/or the fan is stopped while the damper of the storage compartment is being closed.

According to a method of controlling a refrigerator of the prior art, the following problems occur.

First, since the procedure of driving the compressor as the temperature of the storage compartment in the refrigerator is increased to the set temperature or more and then stopping the driving of the compressor as the temperature of the storage compartment is decreased to the set temperature or less, is repeated, the storage compartment has a great temperature variation width so the freshness of foods stored in the storage compartment is lowered.

In addition, since the temperature sensor provided in the storage compartment is installed in a place which is less sensitive to the influence of a cooling air, even if the setting range of the temperature is changed, it is difficult to precisely and constantly control the temperature.

DISCLOSURE OF INVENTION

Technical Problem

The present invention provides a refrigerator capable of maintaining a storage compartment at a constant temperature to improve the freshness of a stored article.

The present invention provides a refrigerator capable of reducing the restriction on the installation position of a temperature sensor.

The present invention provides a refrigerator capable of controlling a temperature of a storage compartment to a constant temperature even if a temperature sensor representing lower resolution is used.

Solution to Problem

According to an aspect of the present invention, there is provided a method of controlling a refrigerator may include: controlling a cooling unit such that an output of the cooling unit becomes a first reference output for a first reference time which is previously determined; controlling the cooling unit such that the output of the cooling unit becomes a second reference output for a second reference time which is previously determined; calculating a representative value of a temperature of a storage compartment for an operating period, which is made by a sum of the first reference time and the second reference time, and comparing the calculated representative value with a specific temperature in a temperature satisfying range of the storage compartment; and varying, by a control unit, at least one of the first reference time and the second reference time depending on a comparison result between the specific temperature and the representative value and controlling operating of the cooling unit based on a varied reference time.

The representative value may be an average temperature of the storage compartment.

The specific temperature may be a target temperature of the storage compartment.

The first reference output may be greater than a minimum output of the cooling unit and is equal to or less than a maximum output of the cooling unit, and the second reference output may be equal to or greater than the minimum output of the cooling unit or is zero.

The cooling unit may include at least one of a compressor and a fan driving unit.

The cooling unit may include a damper to adjust cooling air flow inside a duct which guides cooling air of a freezing compartment to a refrigerating compartment, and a damper driving unit to drive the damper.

The first reference output may be an output of the damper driving unit when an open angle of the damper is a first open angle, and the second reference output may be an output of the damper driving unit when the open angle of the damper is a second open angle smaller than the first open angle.

According to the present invention, the control unit may maintain the first reference time and the second reference time, which are previously determined, if a difference between the specific temperature and the calculated representative value is zero or is in a maintaining reference temperature range.

Further, if the difference between the specific temperature and the calculated representative value is greater than zero or an upper limit of the maintaining reference temperature range, the control unit may decrease the first reference time or increase the second reference time while constantly maintaining the sum of the first reference time and the second reference time.

Further, if the difference between the specific temperature and the calculated representative value is greater than zero or an upper limit of the maintaining reference temperature range, the control unit may decrease the first reference time while constantly maintaining the second reference time.

According to the present invention, if the difference between the specific temperature and the calculated representative value is greater than zero or an upper limit of a maintaining reference temperature range, the control unit may increase the second reference time while constantly maintaining the first reference time.

Further, if the difference between the specific temperature and the calculated representative value is less than zero or greater than a lower limit of the maintaining reference temperature range, the control unit may increase the first reference time or decrease the second reference time while constantly maintaining the sum of the first reference time and the second reference time.

In addition, if the difference between the specific temperature and the calculated representative value is less than zero or greater than a lower limit of the maintaining reference temperature range, the control unit may increase the first reference time while constantly maintaining the second reference time.

Further, if the difference between the specific temperature and the calculated representative value is less than zero or greater than a lower limit of the maintaining reference temperature range, the control unit may decrease the second reference time while constantly maintaining the first reference time.

In addition, if the representative value of the storage compartment becomes equal to or greater than a first reference temperature which is an upper limit of the temperature satisfying range, the control unit may maintain the output of the cooling unit to the first reference output for one operating period.

Further, if the representative value of the storage compartment becomes equal to or less than a second reference temperature which is a lower limit of the temperature satisfying range, the control unit may maintain the output of the cooling unit to the second reference output for one operating period.

The control unit may determine a variation width in a length of the first reference time and a variation width in a length of the second reference time, based on a difference of a previous representative value of the storage compartment and a present representative value of the storage compartment.

According to another aspect, a refrigerator includes: a cabinet having a storage compartment; a compressor operating to cool the storage compartment; a fan to circulate cooling air of the storage compartment; a fan driving unit to rotate the fan; and a control unit to control the fan driving unit and the compressor. The control unit controls at least one of the compressor and the fan driving unit to have a first reference output for a first reference time, which is previously determined, and then controls the at least one of the compressor and the fan driving unit to have a second reference output for a second reference time which is previously determined; calculates a representative value of the temperature of the storage compartment for an operating period made by the sum of the first reference time and the second reference time; compares the calculated representative value with a specific temperature in a temperature satisfying range of the storage compartment; varies at least one of the first reference time and the second reference time depending on the comparison result between the representative value and the specific temperature; and controls the operation of the at least of the compressor and the fan driving unit based on the varied reference time.

According to a still another aspect, a refrigerator includes: a cabinet having a freezing compartment and a refrigerating compartment; a compressor operating to cool the freezing compartment; a fan to circulate cooling air of the freezing compartment; a damper positioned over a duct to guide the cooling air of the freezing compartment to the refrigerating compartment; a damper driving unit which drives the damper; and a control unit to control the fan driving unit. The control unit controls the damper driving unit to have a first reference output for a first reference time, which is previously determined, and then controls the damper driving unit to have a second reference output for a second reference time which is previously determined; calculates a representative value of the temperature of the refrigerating compartment for an operating period made by the sum of the first reference time and the second reference time; compares the calculated representative value with a specific temperature in a temperature satisfying range of the refrigerating compartment; varies at least one of the first reference time and the second reference time depending on the comparison result between the representative value and the specific temperature; and controls the operation of the damper driving unit based on the varied reference time.

According to still another aspect of the present invention, there is provided a method of controlling a refrigerator having a cooling unit for supplying cooling air in a storage compartment, and having an operating period including a first reference time, for which the cooling unit is controlled to have a predetermined output and a second reference time, in which the cooling unit is controlled to have a predetermined output different from the output of the cooling unit for the first reference time, at least one of the first operating reference time and the second reference time being varied. The method includes: controlling the cooling unit such that the output of the cooling unit becomes a first reference output, which has a value greater than zero, for the first reference time which is previously determined; and controlling the cooling unit such that the output of the cooling unit becomes a second reference output, which has a value lower than the value of the first reference output, for the second reference time which is previously determined.

An occupation percentage of the first reference time may be reduced in a whole time of the operating period, which is made by a sum of the first reference time and the second reference time, if a representative value of a temperature of the storage compartment is lower than a lower limit of a temperature satisfying range of the storage compartment.

The occupation percentage of the first reference time may be increased in the whole time of the operating period made by the sum of the first reference time and the second reference time, if the representative value of the temperature of the storage compartment is higher than an upper limit of the temperature satisfying range of the storage compartment.

The first reference time and the second reference time may be maintained in the whole time of the operating period made by the sum of the first reference time and the second reference time, if the representative value of the temperature of the storage compartment is in the temperature satisfying range of the storage compartment.

The representative value may be: an average temperature value of the storage compartment for the operating period made by the sum of the first reference time and the second reference time; an average temperature value of the storage compartment for the first reference time; or an average temperature value of the storage compartment for the second reference time.

In addition, the representative value may be: a temperature of the storage compartment at an end of the second reference time; or a temperature of the storage compartment at an end of the first reference time.

Further, the representative value may be: a specific value between a maximum value and a minimum value of a temperature of the storage compartment for the operating period made by the sum of the first reference time and the second reference time.

Further, the representative value may be: a specific value between a maximum value and a minimum value of a temperature of the storage compartment for the first reference time; or a specific value between a maximum value and a minimum value of the temperature of the storage compartment for the second reference time.

Advantageous Effects of Invention

According to the suggested invention, as the output of the cooling is varied and the reference time for which the output is maintained is varied, based on the temperature variation of the storage compartment, the average temperature of the storage compartment may be maintained approximately to the set temperature. Accordingly, the freshness of an article stored in the storage compartment may be improved, and the protection period of the article may be increased.

In addition, the temperature of the storage compartment may be rapidly recovered even if the temperature of the storage compartment deviates from a constant temperature state.

Further, according to the present invention, since the operating time of the cooling unit may be varied due to the difference between the set temperature and the average temperature of the storage compartment, the temperature variation width at the installation point of the temperature sensor may be reduced and thus the restrictions on the installation position of the temperature sensor may be reduced.

In addition, according to the present invention, since the operating time of the cooling unit may be varied due to the difference between the set temperature and the average temperature of the storage compartment, even if the temperature sensor has lower resolution, the temperature variation width of the storage compartment may be reduced.

BRIEF DESCRIPTION OF DRAWINGS

FIG. 1 is a perspective view of a refrigerator according to an embodiment of the present invention.

FIG. 2 is a view schematically illustrating the configuration of the refrigerator according to an embodiment of the present invention.

FIG. 3 is a block diagram of a refrigerator according to the present invention.

FIG. 4 is a flowchart illustrating a method of controlling a refrigerator according to an embodiment of the present invention.

FIG. 5 is a graph illustrating a temperature variation of a storage compartment as a cooling unit is controlled according to an embodiment of the present invention.

FIG. 6 is a graph illustrating a temperature variation of a storage compartment as a cooling unit is controlled according to another embodiment of the present invention.

FIG. 7 is a graph illustrating a temperature variation of a storage compartment as a cooling unit is controlled according to still another embodiment of the present invention.

MODE FOR THE INVENTION

Hereinafter, some embodiments of the present disclosure will be described in detail with reference to accompanying drawings. In the following description, the same reference numerals will be assigned to the same elements even though the elements are illustrated in different drawings. In addition, in the following description of an embodiment of the present disclosure, a detailed description of well-known features or functions will be ruled out in order not to unnecessarily obscure the gist of the present disclosure.

In the following description of elements according to an embodiment of the present disclosure, the terms 'first', 'second', 'A', 'B', '(a)', and '(b)' may be used. The terms are used only to distinguish relevant elements from other elements, and the nature, the order, or the sequence of the relevant elements is not limited to the terms. When a certain element is liked to, coupled to, or connected with another element, the certain element may be directly linked to or connected with the another element, and a third element may be linked, coupled, or connected between the certain element and the another element.

FIG. 1 is a perspective view of a refrigerator according to an embodiment of the present invention. FIG. 2 is a view schematically illustrating the configuration of the refrigerator according to an embodiment of the present invention. FIG. 3 is a block diagram of a refrigerator according to the present invention.

Referring to FIGS. 1 to 3, a refrigerator 1 according to an embodiment of the present invention may include a cabinet 11 in which a storage compartment is formed and a storage compartment door coupled to the cabinet 11 to open or close the storage compartment.

The storage compartment may include a freezing compartment 111 and a refrigerating compartment 112, and the freezing compartment 111 and the refrigerating compartment 112 may store an article such as foods.

The freezing compartment 111 and the refrigerating compartment 112 may be placed left and right or up and down of the inner part of the cabinet 11 by a partition 113.

The storage compartment door may include a freezing compartment door 15 to open or close the freezing compartment 111 and a refrigerating compartment door 16 to open or close the refrigerating compartment 112. The refrigerating compartment door 16 may further include, but is not limited to, a sub-door 17 allowing a user to withdraw an article stored in the refrigerating compartment door 16 without opening the refrigerating compartment door 16.

In addition, the partition 113 include a connection fluid passage (not illustrated) serving as a cooling air passage for supplying cooling air to the refrigerating compartment 112. A damper 12 is installed in the connection fluid passage (not illustrated) to open or close the connection fluid passage. Alternatively, a cooling air duct may be provided inside the refrigerating compartment 112 to discharge the cooling air, and the damper 12 may open or close a fluid passage in the cooling air duct.

In addition, the refrigerator 1 may further include a cooling cycle 20 to the freezing compartment 111 and/or the refrigerating compartment 112.

In detail, the cooling cycle 20 includes a compressor 21 to compress a refrigerant to a high temperature and high pressure vapor-phase refrigerant, a condenser 22 to condense the refrigerant, which has passed through the compressor 21, to a high temperature and high pressure liquid-phase refrigerant, an expansion member 23 to expand the refrigerant which has passed through the condenser 22, and an evaporator to evaporate the refrigerant which has passed through the expansion member 23. In addition, the evaporator 24 may include an evaporator for a freezing compartment.

In addition, the refrigerator 1 may include a fan 26, which allows air to flow toward the evaporator 24 for the circulation of cooling air in the freezing compartment 111, and a fan driving unit 25 to drive the fan 26.

According to the present invention, to supply the cooling air to the freezing compartment 111, the compressor 21 and the fan driving unit 25 have to be actuated. To supply the cooling air to the refrigerating compartment 112, not only are the compressor 21 and the fan driving unit 25 actuated, but the damper 12 has to open the fluid passage. In this case, the damper 12 may be operated by a damper driving unit 13.

According to the present invention, the compressor 21, the fan driving unit 25, and the damper 12 (or a damper driving unit) are collectively named cooling unit operating to supply the cooling air to the storage compartment.

In addition, according to the present invention, when the cooling unit includes the compressor 21 and the fan driving unit 25, the wording the cooling unit operates refers to that the compressor 21 and the fan driving unit 25 are turned on, and the wording the cooling unit stops refers to that the compressor 21 and the fan driving unit 25 are turned off.

In addition, when the cooling unit includes the damper 12, the wording the cooling unit operates refers to that cooling air of the freezing compartment 111 flows into the refrigerating compartment 112 as the damper 12 opens the fluid passage, and the wording the cooling unit stops refers to that the cooling air of the freezing compartment 111 does not flow into the refrigerating compartment 112 as the damper 12 closes the fluid passage.

The refrigerator 1 may include a freezing compartment temperature sensor 41 to sense the temperature of the freezing compartment 111, a refrigerating compartment temperature sensor 42 to sense the temperature of the refrigerating compartment 112, and a control unit 50 to control the cooling unit based on the temperatures sensed by the temperature sensors 41 and 42.

The control unit 50 may control at least one of the compressor 21 and the fan driving unit 25 to maintain the temperature of the freezing compartment 111 to a target temperature.

For example, the control unit 50 may control at least one of a first reference time, for which the fan driving unit 25 and the compressor 21 are in the state of a first reference output, and a second reference time for which the fan driving unit 25 and the compressor 21 are in the state of a second reference output lower than the first reference output.

Alternatively, the control unit 50 may control at least one of a first reference time, for which at least one of the compressor 21, the fan driving unit 25, and the damper driving unit 13 is in the state of a first reference output to maintain the temperature of the refrigerating compartment 112 to a target temperature and a second reference time for which at least one of the compressor 21, the fan driving unit 25, and the damper driving unit 13 is in the state of a second reference output lower than the first reference output.

For example, the control unit 50 may vary an open time (in which the damper has a first open degree) or a closing time (in which the damper has a second open degree which is zero) of the damper 12, or the open time and the closing time of the damper 12 while the compressor 21 and the fan driving unit 25 are operating to have constant outputs.

Alternatively, while the compressor 21 and the fan driving unit 25 are operating to have constant outputs, the control unit 50 may control at least one of a first reference time for which the damper 12 is open at a first open degree and a second reference time for which the damper 12 is open at a second open degree smaller than the first open degree.

According to the present invention, the first reference output is greater than the minimum output of the cooling unit and equal to or less than the maximum output of the cooling unit. The second reference output is equal to or greater than the minimum output of the cooling unit or is zero.

If the second reference output is equal to or greater than the minimum output, although the cooling unit continuously operates for one operating period, but the output of the cooling unit may be varied.

Meanwhile, when the second reference output is zero, the first reference time is an operating reference time, and the second reference time is a stop reference time of the cooling unit. In other words, the cooling unit is stopped for the second reference time.

In some cases, the output of the cooling unit for the second reference time is lower than the output of the cooling unit for the first reference time.

Accordingly, as long as an external influence is not exerted or the refrigerator does not abnormally operate, the temperature of the storage compartment is decreased for the first reference time and is increased for the second reference time.

The first reference output is an output of the damper driving unit 13 when the open degree of the damper 12 is the first open degree, and the second reference output is an output of the damper driving unit 13 when the open degree of the damper 12 is the second open degree.

A set temperature may be stored in the memory 52. In addition, the memory 52 may store, in the form of a table, the first reference time and the second reference time of the cooling unit according to the temperature difference between the set temperature and a representative value (for example, an average temperature) of the storage compartment sensed by the temperature sensors 41 and 42 and/or the variation percentage (for example, an average temperature variation percentage) of the representative value of the storage compartment.

In this specification, hereinafter, the temperature higher than the target temperature of the refrigerating compartment 112 is referred to as a first refrigerating compartment reference temperature, and the temperature lower than the target temperature of the refrigerating compartment 112 is referred to a second refrigerating compartment reference temperature.

In addition, hereinafter, the temperature higher than the target temperature of the freezing compartment 111 is referred to as a first freezing compartment reference temperature, and the temperature lower than the target temperature of the freezing compartment 111 is referred to a second freezing compartment reference temperature.

The range between the first refrigerating compartment reference temperature and the second refrigerating compartment reference temperature may be referred to as a set temperature range (or a temperature satisfying range) for the refrigerating compartment.

In addition, a specific temperature between the first refrigerating compartment reference temperature and the second refrigerating compartment may be referred to as a third reference temperature. The third reference temperature may be the set temperature (target temperature) or the average of the first refrigerating compartment reference temperature and the second refrigerating compartment reference temperature.

In this case, the first refrigerating compartment reference temperature is an upper limit of the temperature satisfying range for the refrigerating compartment and the second refrigerating compartment reference temperature is a lower limit of the temperature satisfying range for the refrigerating compartment.

The range between the first freezing compartment reference temperature and the second freezing compartment reference temperature may be referred to as a set temperature range (or a temperature satisfying range) for the freezing compartment. In addition, a specific temperature between the first freezing compartment reference temperature and the second freezing compartment may be referred to as a fourth reference temperature. The fourth reference temperature may be the set temperature (target temperature) or the average of the first freezing compartment reference temperature and the second freezing compartment reference temperature.

In this case, the first freezing compartment reference temperature is an upper limit of the temperature satisfying range for the freezing compartment and the second freezing compartment reference temperature is a lower limit of the temperature satisfying range for the freezing compartment.

The control unit 50 may control the cooling unit such that the target temperature of the freezing compartment 111 and/or the target temperature of the refrigerating compartment 112 are maintained in the set temperature range.

Hereinafter, a method of controlling the storage compartment to be at a constant temperature will be described.

First, a basic logic of controlling the storage compartment to be at the constant temperature will be described.

FIG. 4 is a flowchart illustrating a method of controlling a refrigerator according to an embodiment of the present invention.

Referring to FIG. 4, as one example of the basic logic, the case that the first reference time is an operating reference time, and the second reference time is a stop reference time will be described.

The control unit 50 operates the cooling unit for the operating reference time when the refrigerator 1 is powered on (S1). Accordingly, during the operating of the cooling unit, the temperature of the storage compartment is decreased.

Then, the control unit 50 may stop the operating of the cooling unit for the stop reference time (S2). In general, in the state that the cooling unit is stopped, the temperature of the storage compartment is increased.

When the refrigerator 1 is powered on, the cooling unit may operate, based on an operating reference time and a stop reference time, which are most recently determined and stored in the memory 52. Alternatively, when the refrigerator 1 is powered on, the cooling unit may operate based on an operating reference time having the maximum value and a stop reference time having the minimum value.

According to the present embodiment, the control unit 50 may vary the operating reference time and the stop reference time, based on the representative value (for example, the average temperature) of the storage compartment sensed by the temperature sensors 41 and 42. However, according to the present embodiment, the control unit 50 may maintain the sum (operating period) of the operating reference time and the stop reference time to a constant value.

Then, the control unit 50 calculates the average temperature of the storage compartment for the one operating period of the cooling unit (S3).

The control unit 50 calculates the difference between a specific temperature (for example, the set temperature) in the temperature satisfying range and the calculated average temperature (S4). In addition, the control unit 50 may constantly maintain the operating period of the cooling unit based on the difference between the set temperature and the calculated average temperature. In this case, the control unit 50 may maintain the operating reference time and the stop reference time to current levels or may vary the operating reference time and the stop reference time.

For example, the control unit 50 may determine whether the difference between the set temperature and the calculated average temperature is zero (S5).

When the difference between the set temperature and the calculated average temperature is zero, it can be recognized that the temperature of the storage compartment is maintained to the set temperature. Accordingly, the control unit 50 may maintain the current operating reference time and the current stop reference time of the cooling unit (S6).

For another example, even if the difference between the set temperature and the calculated average temperature is not zero, when the difference is less than a maintaining reference temperature difference, since the temperature of the storage compartment is maintained approximately to the set temperature, the control unit 50 may maintain the current operating reference time and the current stop reference time of the cooling unit For example, the maintaining reference temperature difference may be, but is not limited to, 0.05° C.

Meanwhile, if the difference between the set temperature and the calculated average temperature is not zero according to the determination result in step S5, the control unit 50 may determine whether the difference between the set temperature and the calculated average temperature is greater than zero (S7).

When the difference between the set temperature and the calculated average temperature is greater than zero, the control unit 50 may calculate or determine the operating reference time and the stop reference time or extract the operating reference time and the stop reference time from the memory 52, based on the size of the difference (S8).

When the difference between the set temperature and the calculated average temperature is greater than zero, the average temperature of the storage compartment is maintained to be lower than the target temperature, and the average temperature needs to be maintained more approximately to the set temperature. To make the average temperature approximating to the set temperature, the temperature of the storage compartment needs to be increased.

Accordingly, the control unit 50 may decrease the operating reference time of the cooling unit and may increase the stop reference time of the cooling unit (S9).

As long as power is turned off (S12), the control unit 50 may control the cooling unit with the determined operating reference time and the determined stop reference time.

For example, when the cooling unit includes the compressor 21 and the fan driving unit 25, the control unit 50 may decrease the operating reference time of the compressor 21 and the fan driving unit 25 and may increase the stop reference time of the compressor 21 and the fan driving unit 25.

When the cooling unit is the damper 12, the control unit 50 may decrease the open time of the damper 12 and may increase the closing time of the damper 12.

When the difference between the set temperature and the calculated average temperature is not greater than zero according to the determination result in step S7, the control unit 50 may calculate or determine the operating reference time and the stop reference time or extract the operating reference time and the stop reference time from the memory 52, based on the size of the difference (S10).

When the difference between the set temperature and the calculated average temperature is less than zero, the average temperature of the storage compartment is maintained to be higher than the target temperature, and the average temperature needs to be maintained more approximately to the set temperature. To make the average temperature approximating to the set temperature, the temperature of the storage compartment needs to be increased.

Accordingly, the control unit 50 may decrease the operating reference time of the cooling unit and may increase the stop reference time of the cooling unit (S11).

As long as power is not turned off (S12), the control unit 50 may control the cooling unit with the determined operating reference time and the determined stop reference time.

For another example, step S7 may be substituted with step S7-1 of determining whether the difference between the set temperature and the average temperature is greater than an upper limit of the maintaining reference temperature or step S7-2 of determining whether the difference between the set temperature and the average temperature is greater than the lower limit of the maintaining reference temperature.

FIG. 5 is a graph illustrating a temperature variation of a storage compartment as a cooling unit is controlled according to an embodiment of the present invention.

Hereinafter, the procedure of varying the operating reference time and the stop reference time will be described with reference to FIG. 5.

In this case, it is assumed that the set temperature of the storage compartment is 5° C.

The control unit 50 operates the cooling unit for the previously-determined operating reference time and then stops the cooling unit for the previously-determined stop reference time.

In addition, the control unit 50 calculates the average temperature for one operating period. In this case, it is assumed that the calculated average temperature of the storage compartment is 6° C.

In this case, since the difference between the set temperature and the calculated average temperature is 1° C., the control unit 50 determines the operating reference time and the stop reference time corresponding to 1° C.

In other words, the control unit 50 increases a next operating reference time rather than a previous operating reference time and decreases a next stop reference time rather than a previous stop reference time.

In addition, the control unit 50 operates the cooling unit for the increased operating reference time and stops the cooling unit for the decreased stop reference time.

In addition, the control unit 50 additionally calculates the average temperature for one operating period. In this case, it is assumed that the calculated average temperature of the storage compartment is 5.5° C.

In this case, since the difference between the set temperature and the calculated average temperature is 0.5° C. The control unit 50 determines the operating reference time and the stop reference time corresponding to 0.5° C.

In other words, the control unit 50 increases an operating reference time and decreases a stop reference time for a next operating period when the difference between the set temperature and an average temperature calculated for each operating period is greater than 0.

Through the procedure of controlling the cooling unit, the average temperature of the storage compartment may be lowered from 5.5° C. to 5.2° C., and then may be lowered from 5.2° C. to 4.8° C.

When the average temperature of the storage compartment is 4.8° C., since the average temperature is lower than the set temperature, the control unit 50 may decrease an operating reference time to be less than a previous operating reference time and may increase a stop reference time to be greater than a previous stop reference time, for a next operating period, to increase the average temperature of the storage compartment.

The average temperature of the storage compartment may be maintained approximately to the setting temperature by varying the operating reference time and the stop reference time.

Next, a protection logic will be described.

As described above, in the procedure that the average temperature of the storage compartment is maintained approximately to the set temperature through the basic logic, when external air having a temperature lower than that of the air of the storage compartment is introduced into the storage compartment, or a cold source is additionally introduced into the storage compartment in the state that the refrigerator door is open, the storage compartment may be excessively cooled. Accordingly, the temperature of the storage compartment has to be rapidly increased.

Accordingly, when the average temperature of the storage compartment becomes a value equal to or lower than the second reference temperature (the second refrigerating compartment reference temperature or the second freezing compartment reference temperature), the control unit 50 may continuously maintain the cooling unit in a stop state for one operating period. In other words, the operating reference time of the cooling unit may be set to zero.

Next, if the average temperature of the storage compartment becomes higher than the second reference temperature, the protection logic may be released such that the cooling unit is controlled with an operating reference time and a stop reference time determined right before the protection logic is performed.

In contrast, if the average temperature of the storage compartment fails to arrive at the second reference temperature, the protection logic may be repeatedly performed.

In addition, in the procedure that the average temperature of the storage compartment is maintained approximately to the set temperature through the basic logic, when the temperature of the storage compartment is increased or foods are additionally introduced into the storage compartment as the refrigerator door is open, the storage compartment may be overheated. Accordingly, the temperature of the storage compartment is rapidly decreased.

Accordingly, when the average temperature of the storage compartment becomes a value equal to or higher than the first reference temperature (the first refrigerating compartment reference temperature or the first freezing compartment reference temperature), the control unit 50 may continuously maintain the cooling unit in an operating state for one operating period. In other words, the stop reference time of the cooling unit may be set to zero.

Next, if the average temperature of the storage compartment becomes lower than the first reference temperature, the protection logic may be released such that the cooling unit is controlled with an operating reference time and a stop reference time determined right before the protection logic is performed.

In contrast, when the average temperature of the storage compartment fails to arrive at the first reference temperature, the protection logic may be repeatedly performed.

According to the present invention, since the average temperature of the storage compartment is controlled to be approximate to the set temperature, the storage period of an article may be increased. In other words, the foods stored in the storage compartment may be prevented from being overcooled or withered.

In addition, according to the present invention, since the operating time of the cooling unit is varied due to the difference between the set temperature and the average temperature of the storage compartment, the temperature variation may be reduced at a point at which the temperature sensor is installed. Accordingly, the restrictions on the installation position of the temperature sensor may be reduced.

In addition, according to the present invention, since the operating time of the cooling unit is varied due to the difference between the set temperature and the average temperature of the storage compartment, even if the temperature sensor has lower resolution, the temperature variation of the storage compartment may be reduced.

FIG. 6 is a graph illustrating a temperature variation of a storage compartment as a cooling unit is controlled according to still another embodiment of the present invention.

The present embodiment is the same as the previous embodiment except that the control unit varies the stop reference time depending on the difference between the set temperature and the average temperature of the storage compartment in the state that the operating reference time of the cooling unit is constantly maintained. Accordingly, hereinafter, only the feature of the present embodiment will be described.

Referring to FIGS. 4 and 6, the control unit 50 stops the cooling unit for the stop reference time previously determined after operating the cooling unit for the operating reference time.

Even in the present embodiment, it is assumed that the set temperature of the storage compartment is 5° C.

In addition, the control unit 50 calculates the average temperature of the storage compartment for one operating period. In this case, it is assumed that the calculated average temperature of the storage compartment is 6° C.

In this case, since the difference between the set temperature and the calculated average temperature is 1° C., the control unit 50 determines the stop reference time corresponding to 1° C.

In other words, the control unit 50 decreases the stop reference time while constantly maintaining the operating reference time. As the stop reference time is decreased, the increase of the temperature of the storage compartment may be delayed. In addition, if the stop reference time is varied, the operating period is varied.

In addition, the control unit 50 operates the cooling unit for the fixed operating reference time and stops the cooling unit for the decreased stop reference time.

In addition, the control unit 50 additionally calculates the average temperature for one operating period. In this case, it is assumed that the calculated average temperature of the storage compartment is 5.7° C.

In this case, since the difference between the set temperature and the calculated average temperature is 0.7° C., the control unit 50 determines the stop reference time corresponding to 0.7° C.

Accordingly, a next stop reference time is shorter than a previous stop reference time.

As described above, if the stop reference time is decrease for each operating period, the average temperature of the storage compartment is decreased from 5.7° C. to 5.3° C. Next, the average temperature may be decreased from 5.2° C. to 4.9° C.

If the average temperature of the storage compartment becomes 4.9° C., the control unit 50 increases a next stop reference time. However, since the operating reference time is constantly maintained, even if the cooling unit is operate for the operating reference time and then stopped for the increased stop reference time, the average temperature of the storage compartment may be lower than 4.9° C.

In this case, the control unit 50 more increases the length of a next stop reference time, and thus the average temperature of the storage compartment is increased to be approximate to the set temperature.

According to the present invention, since the average temperature of the storage compartment may be maintained approximately to the set temperature, the freshness of an article stored in the storage compartment is increased, and the storage period may be increased.

FIG. 7 is a graph illustrating a temperature variation of a storage compartment as a cooling unit is controlled according to still another embodiment of the present invention.

The present embodiment is the same as the previous embodiment except that the control unit varies the operating reference time depending on the difference between the set temperature and the average temperature of the storage compartment in the state that the stop reference time of the cooling unit is constantly maintained. Accordingly, hereinafter, only the feature of the present embodiment will be described.

Referring to FIGS. 4 and 7, the control unit 50 operates the cooling unit for an operating reference time previously determined and then stops the cooling unit for a stop reference time.

Even in the present embodiment, it is assumed that the set temperature of the storage compartment is 5° C.

In addition, the control unit 50 calculates the average temperature of the storage compartment for one operating period. In this case, it is assumed that the calculated average temperature of the storage compartment is 6° C.

In this case, since the difference between the set temperature and the calculated average temperature is 1° C., the control unit 50 determines the stop reference time corresponding to 1° C.

In other words, the control unit 50 decreases the operating reference time while constantly maintaining the stop reference time. As the operating reference time is increased, the decrement of the temperature of the storage compartment may be increased. In addition, if the stop reference time is varied, the operating period is varied.

In addition, the control unit 50 operates the cooling unit for the increased operating reference time and stops the cooling unit for the fixed stop reference time.

In addition, the control unit 50 additionally calculates the average temperature for one operating period. In this case, it is assumed that the calculated average temperature of the storage compartment is 5.5° C.

In this case, since the difference between the set temperature and the calculated average temperature is 0.5° C., the control unit 50 determines the operating reference time corresponding to 0.5° C.

Accordingly, a next operating reference time becomes shorter than a previous operating reference time.

As described above, if the operating reference time is increased for the next operating period, the average temperature of the storage compartment may be decreased from 5.5° C. to 4.8° C.

If the average temperature of the storage compartment becomes 4.8° C., the control unit 50 increases the next operating reference time. Then, the average temperature of the storage compartment is increased to approximate to 5° C.° In the above embodiments, the variation of the operating reference time and the variation of the stop reference time may be determined based on the difference between the set temperature and the average temperature of the storage compartment. In addition, the variation in the length of the operating reference time and the length of the stop reference time may be determined based on the difference between a previous average temperature and a present average temperature.

For another example, the operating period may include a first reference time for which the cooling unit is controlled to have a predetermined output and a second reference time for which the cooling unit is controlled to have a predetermined output different from the output for the first reference time. At least one of the first reference time and the second reference time may be varied.

In addition, the method of controlling the refrigerator of the present invention may include controlling the cooling unit such that an output of the cooling unit becomes a first reference output having a value greater than zero for a preset first reference time; and controlling the cooling unit such that an output of the cooling unit becomes a second reference output having a value lower than the first reference output for a preset second reference time.

The first reference output may be referred to as a cooling output, and the second reference output may be referred to as a delaying output for delaying the increase of the temperature. The second reference output may be zero.

From the whole time of an operating period made by the sum of the first reference time and the second reference time, the percentage of the first reference time occupying the operating period may be reduced, when the representative value of the temperature of the storage compartment is lower than the lower limit (for example, the second refrigerating compartment reference temperature or the second freezing compartment reference temperature) of the temperature satisfying range of the storage compartment.

For example, the length of the first reference time may be decreased and the length of the second reference time may be maintained or increased.

Alternatively, the length of the first reference time may be maintained and the second reference time may be increased.

From the whole time of an operating period made by the sum of the first reference time and the second reference time, the percentage of the first reference time occupying the operating period may be increased, when the representative value of the temperature of the storage compartment is higher than the upper limit (for example, the first refrigerating compartment reference temperature or the first freezing compartment reference temperature) of the temperature satisfying range of the storage compartment.

For example, the length of the first reference time may be increased and the length of the second reference time may be maintained or decreased.

Alternatively, the length of the first reference time may be maintained and the length of the second reference time may be decreased.

Further, in the whole time of an operating period made by the sum of the first reference time and the second reference time, the first reference time and the second reference time may be maintained when the representative value of the temperature of the storage compartment is in the temperature satisfying range of the storage compartment.

The representative value may be, but is not limited to, an average temperature value of the storage compartment for the operating period made by the sum of the first reference time and the second reference time.

In addition, the representative value may be a temperature of the storage compartment at the end of the second reference time. Alternatively, the representative value may be a temperature of the storage compartment at the end of the first reference time.

In addition, the representative value may be a specific value between the maximum value and the minimum value of the temperature of the storage compartment for the operating period made by the sum of the first reference time and the second reference time. For example, the specific value may be an average value of the maximum value and the minimum value.

Alternatively, the representative value may be a specific value between the maximum value and the minimum value for the first reference time.

Alternatively, the representative value may be a specific value between the maximum value and the minimum value for the second reference time.

Alternatively, the representative value may be an average value of the temperatures of the storage compartment for the first reference time.

Alternatively, the representative value may be an average value of the temperatures of the storage compartment for the second reference time.

Although the type in which cooling air is created and circulated by one evaporator has been described in the above embodiment, the inventive concept may be identically applied to the type in which cooling air is created by using one compressor, an evaporator for a freezing compartment, and an evaporator for a refrigerating compartment. In this case, the damper may be omitted.

In addition, the inventive concept may be identically applied to the type in which cooling air is created by using a plurality of compressors, an evaporator for a freezing compartment, and an evaporator for a refrigerating compartment.

The invention claimed is:

1. A method of controlling a refrigerator, the method comprising:

controlling a cooling unit such that an output of the cooling unit becomes a first reference output for a first reference time which is previously determined;

controlling the cooling unit such that the output of the cooling unit becomes a second reference output for a second reference time which is previously determined;

calculating a representative value of a temperature of a storage compartment for an operating period, which is made by a sum of the first reference time and the second reference time, and comparing the calculated representative value with a specific temperature in a temperature satisfying range of the storage compartment; and varying, by a control unit, at least one of the first reference time and the second reference time depending on a comparison result between the specific temperature and the representative value and controlling operating of the cooling unit based on a varied reference time.

2. The method of claim 1, wherein the representative value is an average temperature of the storage compartment, and wherein the specific temperature is a target temperature of the storage compartment.

3. The method of claim 1, wherein the first reference output is greater than a minimum output of the cooling unit and is equal to or less than a maximum output of the cooling unit, and wherein the second reference output is equal to or greater than the minimum output of the cooling unit or is zero.

4. The method of claim 3, wherein the cooling unit includes at least one of a compressor or a fan driving unit.

5. The method of claim 3, wherein the cooling unit includes:

a damper to adjust cooling air flow inside a duct which guides cooling air of a freezing compartment to a refrigerating compartment, and a damper driving unit to drive the damper, wherein the first reference output is an output of the damper driving unit when an open angle of the damper is a first open angle, and wherein the second reference output is an output of the damper driving unit when the open angle of the damper is a second open angle smaller than the first open angle.

6. The method of claim 1, wherein the control unit maintains the first reference time and the second reference time, which are previously determined, when a difference between the specific temperature and the calculated representative value is zero or is in a maintaining reference temperature range.

7. The method of claim 6, wherein, if the difference between the specific temperature and the calculated representative value is greater than zero or an upper limit of the maintaining reference temperature range, the control unit decreases the first reference time or increases the second reference time while constantly maintaining the sum of the first reference time and the second reference time.

8. The method of claim 6, wherein, if the difference between the specific temperature and the calculated representative value is greater than zero or an upper limit of the maintaining reference temperature range, the control unit decreases the first reference time while constantly maintaining the second reference time.

9. The method of claim 6, wherein, if the difference between the specific temperature and the calculated representative value is greater than zero or an upper limit of a maintaining reference temperature range, the control unit increases the second reference time while constantly maintaining the first reference time.

10. The method of claim 6, wherein, if the difference between the specific temperature and the calculated representative value is less than zero or greater than a lower limit of the maintaining reference temperature range, the control unit increases the first reference time or decreases the second reference time while constantly maintaining the sum of the first reference time and the second reference time.

11. The method of claim 6, wherein, if the difference between the specific temperature and the calculated representative value is less than zero or greater than a lower limit of the maintaining reference temperature range, the control unit increases the first reference time while constantly maintaining the second reference time.

12. The method of claim 6, wherein, if the difference between the specific temperature and the calculated representative value is less than zero or greater than a lower limit of the maintaining reference temperature range, the control unit decreases the second reference time while constantly maintaining the first reference time.

13. The method of claim 6, wherein, if the representative value of the storage compartment becomes equal to or greater than a first reference temperature which is an upper limit of the temperature satisfying range, the control unit maintains the output of the cooling unit to the first reference output for one operating period.

14. The method of claim 6, wherein, if the representative value of the storage compartment becomes equal to or less than a second reference temperature which is a lower limit of the temperature satisfying range, the control unit maintains the output of the cooling unit to the second reference output for one operating period.

15. The method of claim 1, wherein the control unit determines a variation width in a length of the first reference time and a variation width in a length of the second reference time, based on a difference of a previous representative value of the storage compartment and a present representative value of the storage compartment.

16. A method of controlling a refrigerator having a cooling unit for supplying cooling air in a storage compartment, and having an operating period including a first reference time, for which the cooling unit is controlled to have a predetermined output and a second reference time, in which the cooling unit is controlled to have a predetermined output different from the output of the cooling unit for the first reference time, at least one of the first operating reference time and the second reference time being varied, the method comprising:

controlling the cooling unit such that the output of the cooling unit becomes a first reference output, which has a value greater than zero, for the first reference time which is previously determined;

controlling the cooling unit such that the output of the cooling unit becomes a second reference output, which has a value lower than the value of the first reference output, for the second reference time which is previously determined;

reducing an occupation percentage of the first reference time in a whole time of the operating period, which is made by a sum of the first reference time and the second reference time, if a representative value of a temperature of the storage compartment is lower than a lower limit of a temperature satisfying range of the storage compartment;

increasing the occupation percentage of the first reference time in the whole time of the operating period made by the sum of the first reference time and the second reference time, if the representative value of the temperature of the storage compartment is higher than an upper limit of the temperature satisfying range of the storage compartment; and maintaining the first reference time and the second reference time in the whole time of the operating period made by the sum of the first reference time and the second reference time, if the representative value of the temperature of the storage compartment is in the temperature satisfying range of the storage compartment.

17. The method of claim 16, wherein the representative value is:

an average temperature value of the storage compartment for the operating period made by the sum of the first reference time and the second reference time;

an average temperature value of the storage compartment for the first reference time; or an average temperature value of the storage compartment for the second reference time.

18. The method of claim 17, wherein the representative value is:

a temperature of the storage compartment at an end of the second reference time; or a temperature of the storage compartment at an end of the first reference time.

19. The method of claim 17, wherein the representative value is:

a specific value between a maximum value and a minimum value of a temperature of the storage compartment for the operating period made by the sum of the first reference time and the second reference time.

20. The method of claim 17, wherein the representative value is:

a specific value between a maximum value and a minimum value of a temperature of the storage compartment for the first reference time; or a specific value between a maximum value and a minimum value of the temperature of the storage compartment for the second reference time.

* * * * *